US007571508B1

(12) United States Patent
Yufa

(10) Patent No.: US 7,571,508 B1
(45) Date of Patent: Aug. 11, 2009

(54) PORTABLE CLEANING DEVICE

(76) Inventor: Yelena V. Yufa, 698 Cypress Ave., Colton, CA (US) 92324

( * ) Notice: Subject to any disclaimer, the term of this patent is extended or adjusted under 35 U.S.C. 154(b) by 954 days.

(21) Appl. No.: 10/731,234

(22) Filed: Dec. 8, 2003

(51) Int. Cl.
*A46B 13/02* (2006.01)

(52) U.S. Cl. ..... 15/22.1; 15/144.4

(58) Field of Classification Search ..... 15/22.1, 15/23, 28, 144.4
See application file for complete search history.

(56) References Cited

U.S. PATENT DOCUMENTS 2,840,837 A * 7/1958 Gustems ..... 15/23
3,026,552 A * 3/1962 Price ..... 15/97.1
3,343,192 A * 9/1967 Goldstein et al. ..... 15/23
5,269,104 A * 12/1993 DiBiagio ..... 451/344
6,058,542 A 5/2000 Lo
6,170,107 B1 * 1/2001 George et al. ..... 15/24
D482,530 S * 11/2003 Evans ..... D4/102
7,152,266 B1 * 12/2006 Haughton ..... 15/28

* cited by examiner

*Primary Examiner*—Randall Chin

(57) ABSTRACT

This invention provides the web and/or dust cleaning. An improved portable cleaning device comprises a brush portion, including a telescopic portion and a cleaning brush, coupled with the cleaning device handle portion, including a handle, a power supply electrically connected to a reversible motor, providing reversible rotation of the brush portion during web and/or dust cleaning operation, a switching device for motor rotation direction control, and a power supply connecting elements. The motor axle is coupled by a connection block with the telescopic portion of the brush portion. Also, the rotation of the brush portion is provided by a mechanical power-driven device.

2 Claims, 8 Drawing Sheets

61- 61

62- 62

PORTABLE CLEANING DEVICE

FIELD OF THE INVENTION

The invention relates to a cleaning device, and more particularly, to a portable cleaning device for cleaning web and/or dust in a rotatable manner.

BACKGROUND OF THE INVENTION

Web and dust relentlessly collect on the walls, ceiling and furniture making household cleaning a hard chore. The cleaning devices on the market, for example, mops, brushes and scouring pads require a high level of energy expenditure. Most cleaning equipment requires handle rotation of the cleaning brush, for instance, in order to clean (remove) the web from the wall or ceiling. Also, the procedure of the web/dust cleaning has to be repeated a few times for the same place and often in the different direction of cleaning device rotations (e.g. clockwise and counterclockwise), and the user (the cleaning operator) each time manually rotates the cleaning brush. This not only requires an inordinate amount of time but also is ineffective as the user cannot thoroughly clean the subjects. Furthermore, continued use of such manually rotating devices may lead to muscle health problems.

Also, the known manually or non-reversible operating prior arts can not be successfully used by the users who are incapable manually rotate brush (e.g. the users with polyarthritis disease, finger coordination malfunction, etc.), and can not be conveniently and equally used (manually rotated) in the difficult accessible areas by the left- and/or right-handed users.

For example, the cleaning device for general cleaning of the home appliances by U.S. Pat. No. 6,058,542 comprises a housing, having a handle and a chassis, a motor, a cleaning module, an elastic device elastically installed between the cleaning module, a battery set, and the transmission element, comprising a protruded edge, a base plate with openings, and a square shaped protruded bar. The connecting end of the cleaning module comprises a plurality of elastic hooks for engaging the protruded edge of the transmission element, and a square shaped slot for insertion of the protruded bar which drives the device. The elastic hooks at the connecting end comprise elastic material and enable a user to directly attach the connecting end of the cleaning module to the transmission element. When the elastic hooks of the connecting end are secured by the protruded edge, the cleaning module can make slight movements relative to the transmission element along an axial direction. The connecting end of the cleaning module can also be detached from the protruded edge. The elastic device also comprises a spring installed within a buffer cap. The rear end of the buffer cap is hooked onto the base plate of the transmission element. When the connecting end of the cleaning module is attached to the protruded edge, the connecting end will be pushed against the front end of the buffer cap. The elastic device will elastically push the elastic hooks of the connecting end toward the protruded edge to firmly secure the cleaning module and to provide an elastic force that can prevent damage to the appliance during cleaning. The metallic ring is installed on a matched opening of the housing between the matched opening and the cleaning module. When the connecting end of the cleaning module is installed on the transmission element, the end of the connecting end close to the cleaning head of the cleaning module is fitted with another metallic ring for rotatably engaging with the first metallic ring of the matched opening. The cleaning head is a plane circular shaped cleaning head. The cloth fasteners are installed on the rear side of cleaning head for fixing thin cleaning material such as a cotton cloth or emery cloth. Each of the cloth fasteners comprises a plurality of elastic plates with narrow openings between them for clamping the cleaning material on the cleaning head. Also, the cleaning head comprises a plurality of narrow openings for fixing thin cleaning material.

This device, used for general cleaning of home appliances, is complex (including many main and auxiliary components/parts) and does not provide the reversible rotations of the cleaning brush, for example, because the screw threading has made along a direction opposite to the movement direction of the cleaning module when driven by the motor to prevent loosening of the cleaning module.

While this device fulfill it respective, particular objectives and requirements, the mentioned patent does not disclose, teach and/or suggest the portable cleaning device including a reversibly rotatable cleaning brush.

Those skilled in the art will readily observe that numerous modifications and advantages of the improved portable cleaning device with reversible motor may be made while retaining the teachings of the invention.

Thus, the known prior art do not provide the efficient, satisfied and convenient web and/or dust cleaning, and in theses respects, an improved portable cleaning device with the reversibly rotatable cleaning brush according to the present invention substantially departs from the devices of the prior art.

OBJECT AND ADVANTAGES OF THE INVENTION

Accordingly, several objects and advantages of the present invention are to provide an improved portable cleaning device.

It is another object of the invention to increase convenience and efficiency of the improved portable cleaning device eliminating the manual rotation of the brush during web and/or dust cleaning.

It is further object of the invention to provide the brush reversible rotations.

It is still another object of the invention to increase convenience of the improved portable cleaning device for users, having physical malfunction problems, i.e. the users with polyarthritis disease, fingers/wrist/hand coordination malfunction, etc.

It is still further object of the invention to increase convenience of the improved portable cleaning device use for the difficult accessible areas, where the manually or non-reversible cleaning device can not be conveniently and equally used by the left- and/or right-handed users.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

In view of the foregoing disadvantages inherent in the known prior art, the present invention provides a new portable cleaning device with convenience of the reversibly rotated cleaning brush. As such, the general purpose of the present invention, which will be described hereinafter in greater details, is to provide a new portable cleaning device, which has many of the advantages of the web and/or dust cleaning instrument mentioned heretofore and many novel features that result in the reversible rotating cleaning brush, which is not anticipated, rendered obvious, suggested or even implied by any of prior art portable cleaning devices, either alone or in any combination thereof.

To attain this, the present invention generally comprises the device for the web and/or dust cleaning. An improved portable cleaning device includes a brush portion, including a cleaning brush and a telescopic portion coupled with the handle portion, including a handle means, a power supply electrically connected to a reversible motor, providing reversible rotation of the brush portion during web and/or dust cleaning operation, a switching means for motor rotation direction control, and a power supply connecting means. The motor axle is coupled by a connection means with the telescopic portion of the brush portion. Also, the rotation of the brush portion is provided by a mechanical power-driven means.

DESCRIPTION OF THE PREFERRED EMBODIMENTS

With reference now to the drawings, and particularly to FIGS. 1-8 thereof, a new portable cleaning device embodying the principles and concepts of the present invention.

Figure 1:
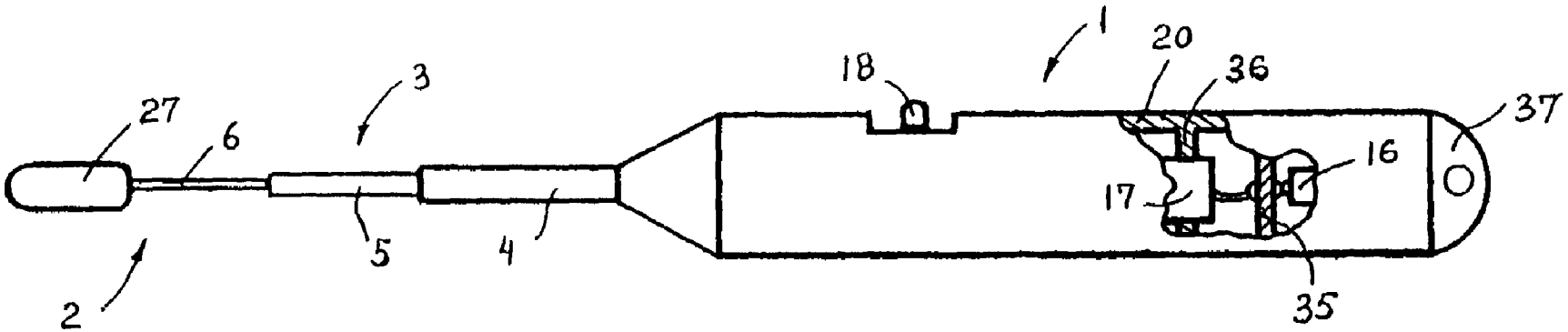
FIG. 1 is a simplified representation of the improved portable cleaning device.
Figure 2:
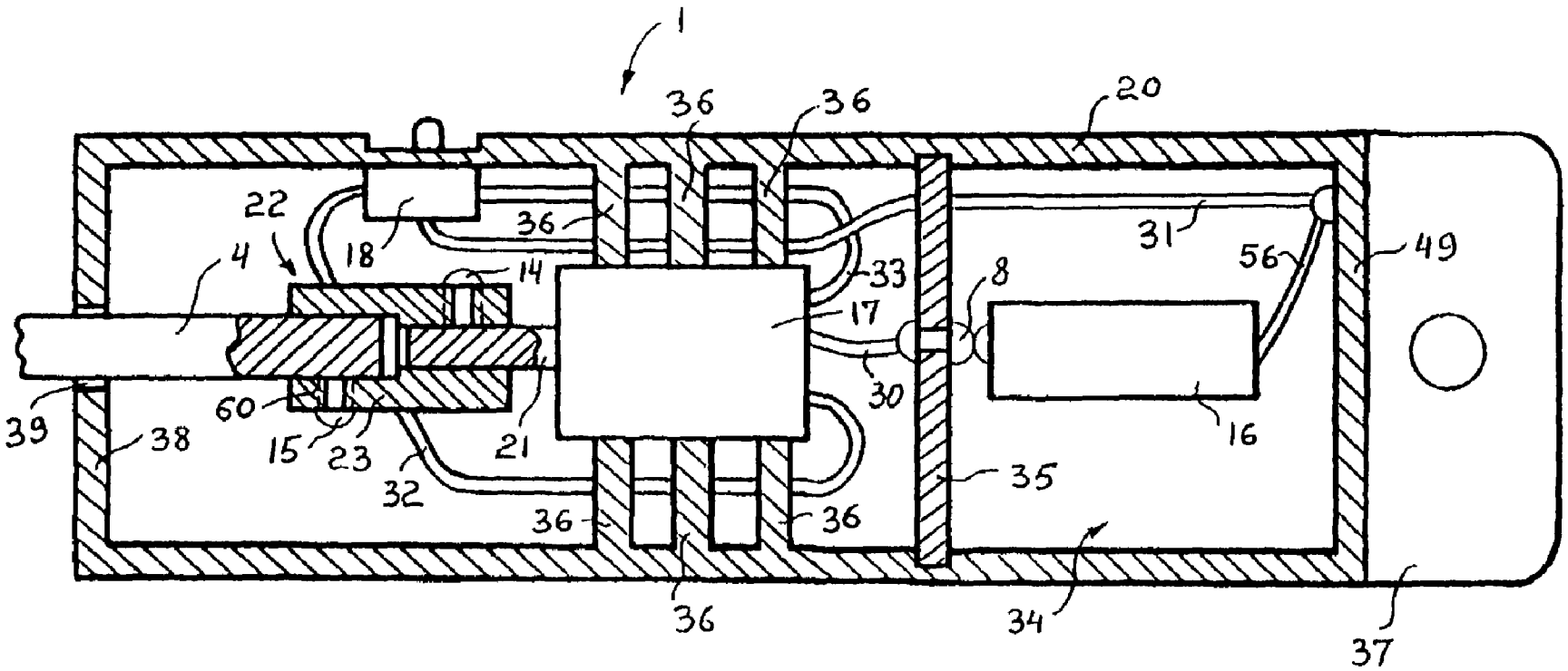
FIG. 2 is a simplified drawing of the handle portion of the improved portable cleaning device.

Referring to FIG. 1, an improved portable cleaning device comprises a handle portion 1, including a handle means 20, an electrical power supply 16 located in the electrical power supply compartment 34, a reversible electrical motor 17 (preferably the low-speed reversible motor) installed into holders 36, a switching means 18, a connection means 22, and hanging means 37 (for example, as shown in FIGS. 1, 2) or the like. The hanging means 37 can be of any form/shape, configuration and size/dimensions, including for example, a hook-shaped hanging means 37 shown in FIG. 7 or a ring-shaped hanging means 37, as shown in FIG. 8, etc. Any quantity and kind of battery/batteries, for example such as "A", "AA", "AAA", "C", watch batteries, etc., can be used as the power supply 16. Also, the improved portable cleaning device includes a brush portion 2, comprising a cleaning brush 27 with the brush axle 26, having a threaded opening 28 at the free end 44, and a fixing means 29. The brush portion 2 also comprises a telescopic portion 3 having an elongated configuration. The telescopic portion 3 can comprise at least one of a plurality "N" (N=1, 2, 3, . . . , i, . . . n−1, n) of sections (in FIG. 1 is conditionally shown the telescopic portion 3 comprising three sections (N=3): a first telescopic section 4, a second telescopic section 5, and a third telescopic section 6). The third telescopic section 6 can include the threaded portion 25 for coupling with the threaded opening 28 of the free end 44 of the brush axle 26 (the internal thread of the opening 28 is engaged with the outer thread of the third telescopic section 6), as simplified shown on FIGS. 5*b*, 6*a*. Any other types of third telescopic section 6 and brush axle 26 coupling can be used, for example, screw connection, tight (friction) connection, slot-corbel lock connection, etc.

Figure 5A:
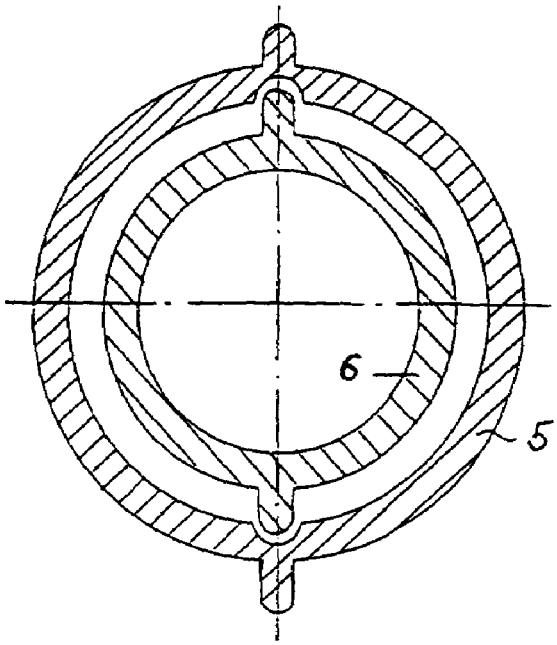
FIG. 5*a*, 5*b* are a simplified drawings of telescopic portion cross-sectional views 61-61, 62-62.

Referring to FIG. 5*a*, all telescopic sections are not rotatable relatively to each other. According FIG. 6*b*, the third telescopic section 6 is not rotatable relatively to the brush axle 26. The fixing means 29 provides (non-unscrewable) coupling of the third telescopic section 6 with the brush axle 26, thereby preventing loosening of the cleaning brush 27 during clockwise or counterclockwise rotation operations of the cleaning device.

Figure 5B:
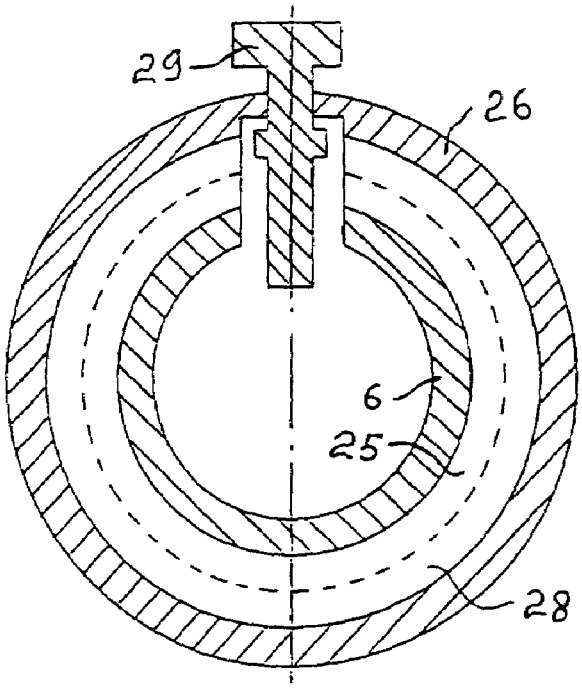
Figure 6A:
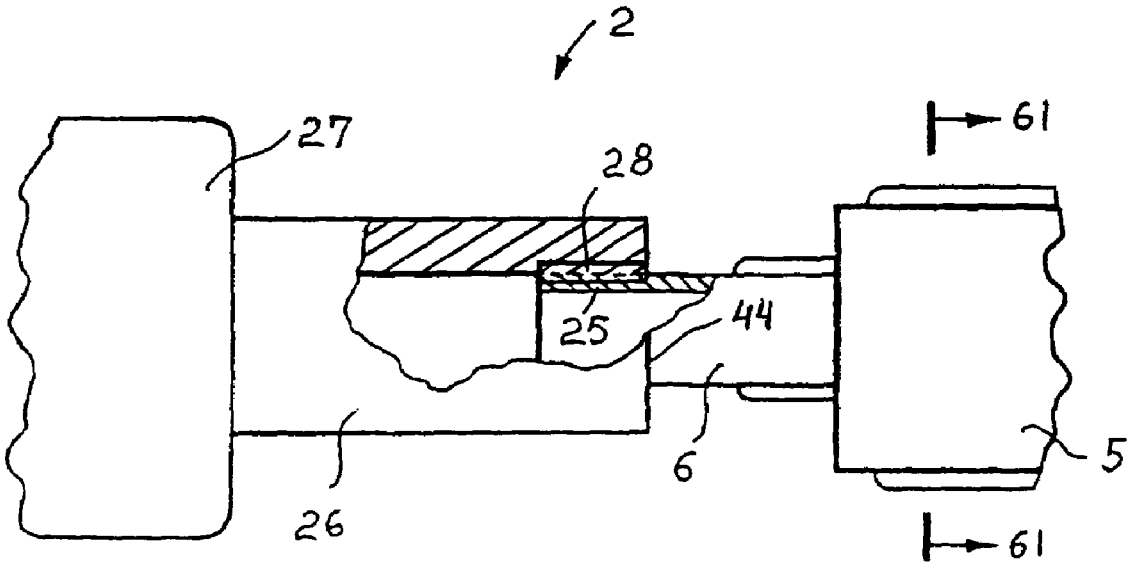
FIGS. 6*a*, 6*b* are a simplified illustrations of the brush portion and telescopic portion coupling.
Figure 6B:
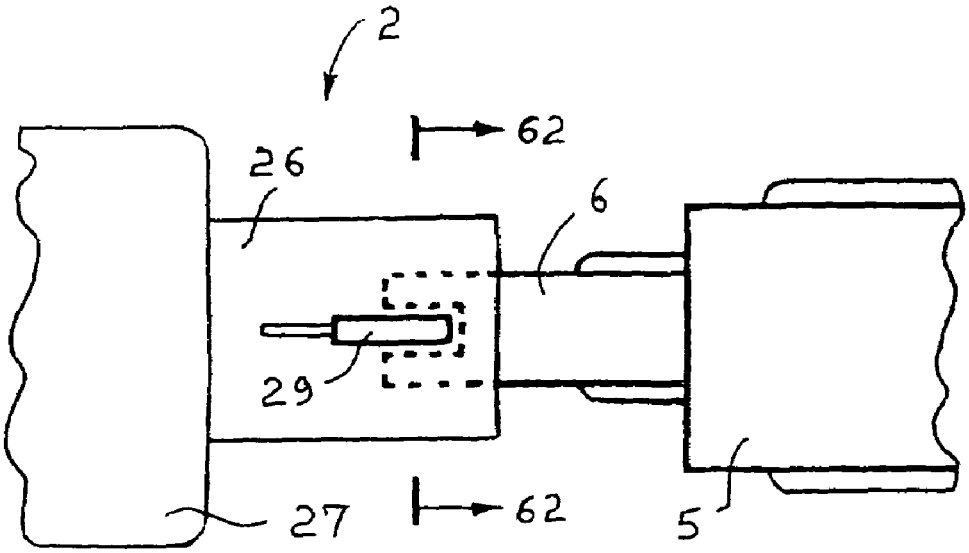

Any other variants of the telescopic section rotation prevention can be used too, for example, the use of the eccentric ring-stopper, etc. On FIGS. 5*a*, 5*b* are conditionally shown the telescopic sections of cylindrical form, but any geometrical form/shape, configuration (e.g. square, triangular configuration, etc.), size/dimensions, material, etc. can be used.

The cleaning brush 27 of the brush portion 2 can be of any geometrical configuration, form/shape (for example, cylindrical form, conic form, etc.), size, and can be interchangeable (replaceable) separately or, for example, together with the brush axle 26.

Figure 3A:
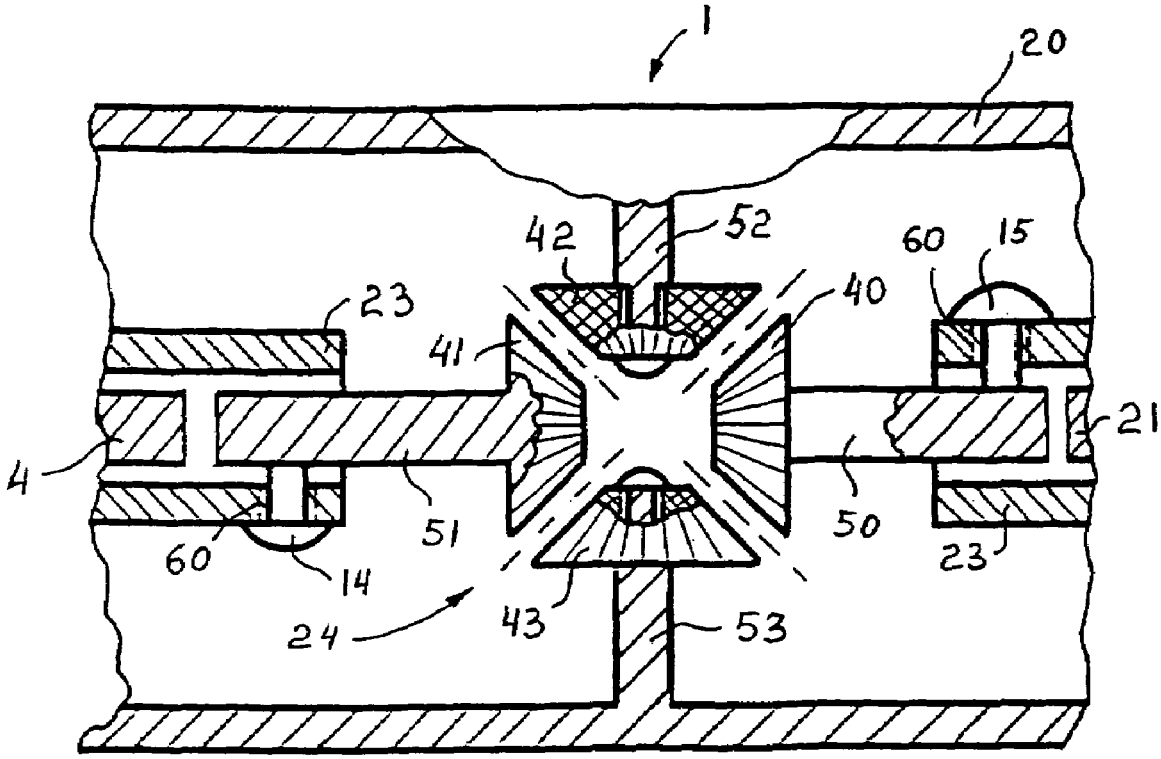
FIG. 3*a*, 3*b* are a simplified drawings of the gear transmitting means of the connection means.

The reversible electrical motor 17 comprises the motor axle 21 extended to the connection means 22. The one side of the connection means 22 is coupled with the motor axle 21, and another side of the connection means 22 is coupled with the first telescopic section 4. The connection means 22, for example, can be presented by any kind of mechanical connecting means, elements and systems, including such as locking-slot connection (not shown) etc. or, for instance, any kind of mechanical transmitting system and means, including such as friction and/or belt transmitting system (not shown) or gear transmitting means 24 presented in FIG. 3*a* etc., or as shown in FIG. 2 by the connecting element 23, for instance, of cylindrical configuration with two screws 14 and 15 located onto two opposite sides of the connecting element 23 preferably at 180° angle respectively. Such housing of the screws 14 and 15 provides the better balance during rotation. The screws 14 and 15 connect the motor axle 21 of the motor 17 and the first telescopic section 4 of the telescopic portion 3 to the connecting element 23 (the appropriate threaded apertures 60 into connecting element 23 for the screws 14 and 15 are shown in FIG. 3*a*). Also, the connection of the motor axle 21 of the motor 17 and the first telescopic section 4 of the telescopic portion 3 can be provided by any reasonable methods and means, for example, by riveting, welding or joggling, etc. The first telescopic section 4 can be connected to the motor axle 21 directly (not shown), for instance, by the screw (not shown) eliminating the connection means 22. The first telescopic section 4 is centered by the aperture 39 located in the front wall 38 of the handle means 20. The front wall 38 preferably has to be made of the material with the minimal coefficient of the friction to provide easy rotation of the first telescopic section 4 into aperture 39. Also, the front wall 38 can be of any geometrical form/shape, configuration, size/dimensions, reasonable material, etc. For example, the front wall 38 can be presented by two front walls 38 (not shown) each with the aperture 39, or the second front wall 38 can be presented, for example, by a conic decorative attachment to the handle means 20 as shown in FIG. 8.

The mentioned of the above gear transmitting means 24 can comprise a first 40, second 41, third 42 and fourth 43 conic gears, as shown on FIG. 3*a*. The axle 50 of the first conic gear 40 is by, for example, a connecting element 23 coupled with the motor axle 21, and the axle 51 of the second conic gear 41 is by, for example, another connecting element 23 coupled with the first telescopic section 4 of the telescopic portion 3. The axles 52 and 53 of the third 42 and fourth 43 conic gears respectively are appropriately rigidly connected to the handle means 20. The first conic gear 40 is rigidly connected to the axle 50 and the second conic gear 41 is rigidly connected to the axle 51. The axles 52 and 53 are non-rigidly coupled with the third 42 and fourth 43 conic gears respectively in order to provide the gears' free rotation on their axes.

Figure 3B:
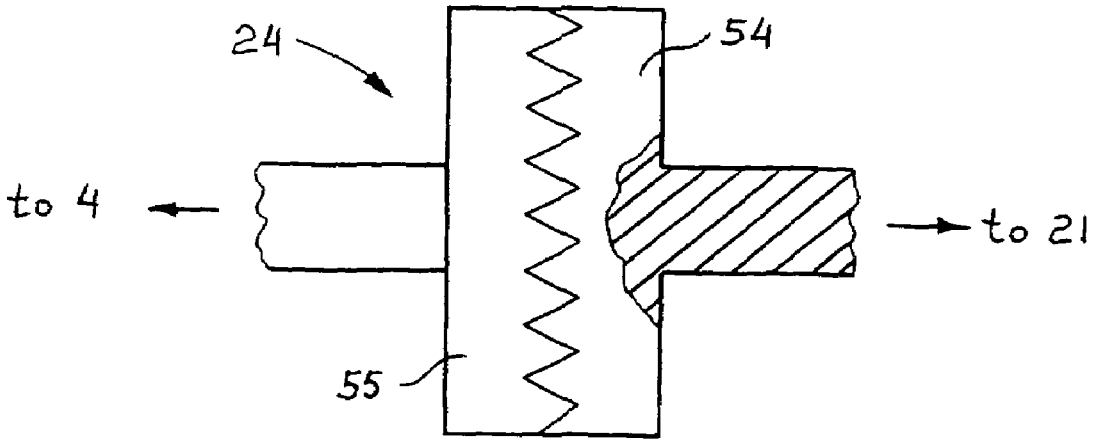

On FIG. 3*b* is shown the another possible variant of the gear transmitting means 24, comprising only two gears: a first gear 54 coupled with the motor axle 21, and the second gear 55 is coupled with the first telescopic section 4.

Figure 4:
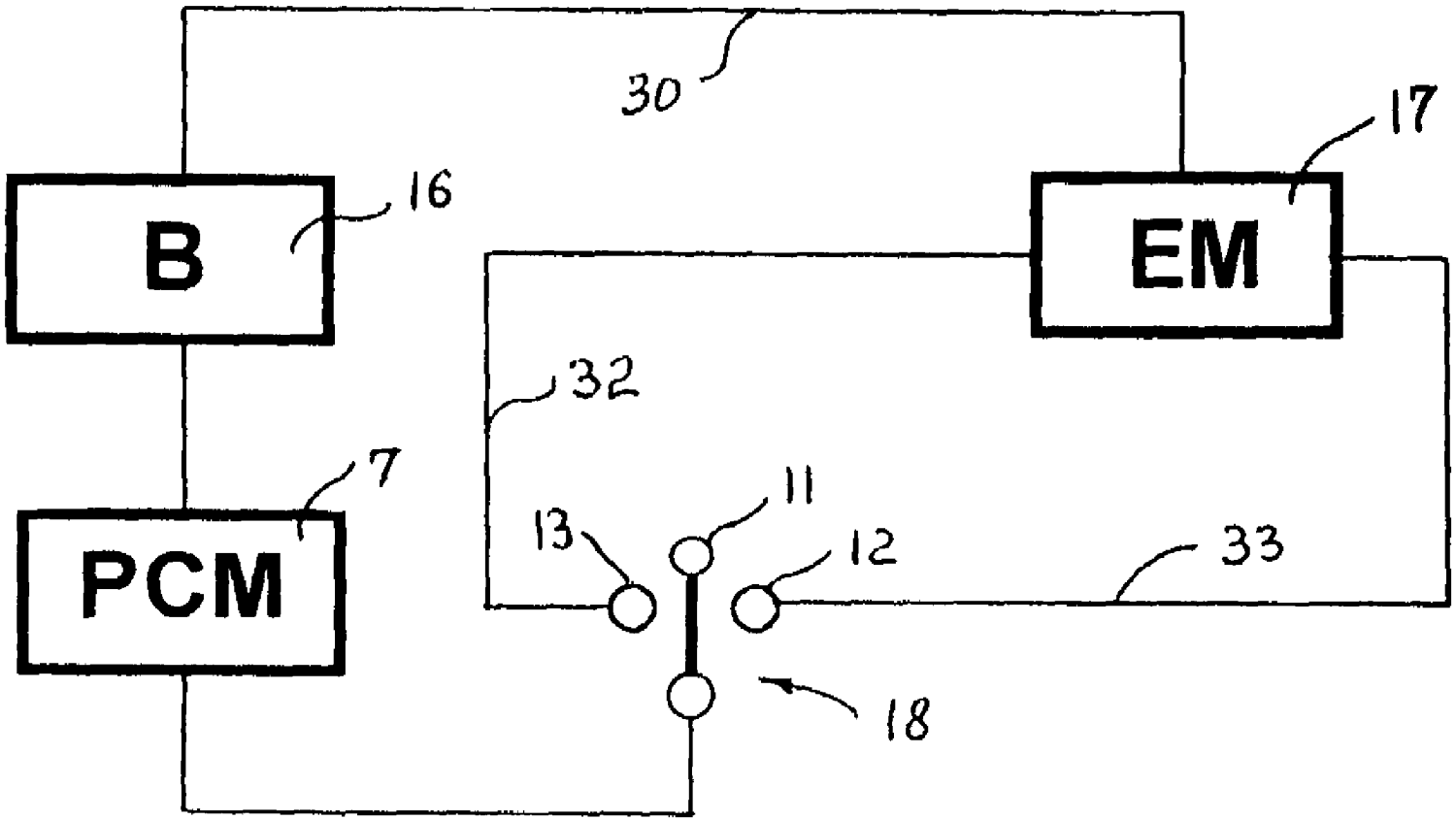
FIG. 4 is a simplified electrical block-scheme.

The reversible motor 17 is electrically connected to the power supply 16 ("B") and to the switching means 18, which is also electrically connected to the power supply 16. The electrical switching means 18 can have, for example, the three positions: "R"-"OFF"-"L" in order to provide clockwise (right—"R") and counterclockwise (left/reverse/—"L") rotations of the cleaning brush 27, as shown in FIG. 4. The switching means position 11 ("OFF") can be located between switching means positions 12 ("R") and switching means position 13 ("L") in order to provide the switching from "R" to "L" or from "L" to "R" through position 11 ("OFF"). The switching means 18 can be of any kind, for example, a rotary switching means (not shown), etc.

The reversible rotation of the cleaning brush 27 provides the equal possibility for users who are incapable manually rotate brush (e.g. the users with polyarthritis disease, finger coordination malfunction, etc.). Also, the use of the brush reversible rotation provides the best cleaning of the long webs, considering the need to repeat the cleaning operation a few times for the same place in the different direction of cleaning device rotations (clockwise and counterclockwise).

The handle means 20 of the handle portion 1 can have a structure of any geometrical and/or ergonomical form (shape) and configuration, for example, of cylindrical form as shown in FIGS. 1, 2, 7, 8, and can be of any size/dimensions.

The first electrical contact 56 and the second electrical contact 8 are used for electrical connection of the battery 16 into electrical circuitry, as shown in FIG. 2. The second electrical contact 8, installed on the power supply compartment wall 35 of the power supply compartment 34, connects one pole of the battery 16 (positive or negative depending on the type of motor 17) to the motor 17 via the first electrical wire 30. The first electrical contact 56, installed at the opposite side of the power supply compartment 34 (for example, on the back wall 49 of the handle means 20, as shown on FIG. 2), connects the another pole of the battery 16 (respectively negative or positive) to the switching means 18 via the second electrical wire 31. The first electrical contact 56 also can be elongated and can be installed at any (preferably inner) place of the handle means 20, for instance, on the inner side of the handle means 20 (e.g. on the inner cylindrical surface of the handle means 20). The first electrical contact 56 and/or second electrical contact 8 can have the spring configuration (on FIG. 2, for example, conditionally only first electrical contact 56 is shown as the spring contact). The electrical wires 32 and 33 connect the motor 17 to the switching means 18, providing control of motor 17 clockwise ("R") or counterclockwise ("L") rotations.

As shown on FIG. 2, the handle means 20 is configured, for example, as two halves (two sections/not shown/) of handle means 20 elongated along longitudinal axes (not shown) of the handle means 20 body. In this case, the power supply compartment 34 can have the side opening, for example, the semi-cylindrical opening (not shown) in order to provide the power supply 16 replacement, or two dissectionable halves of the handle means 20 can be dissected (detached) one from another to provide a replacement of the power supply 16.

Figure 7:
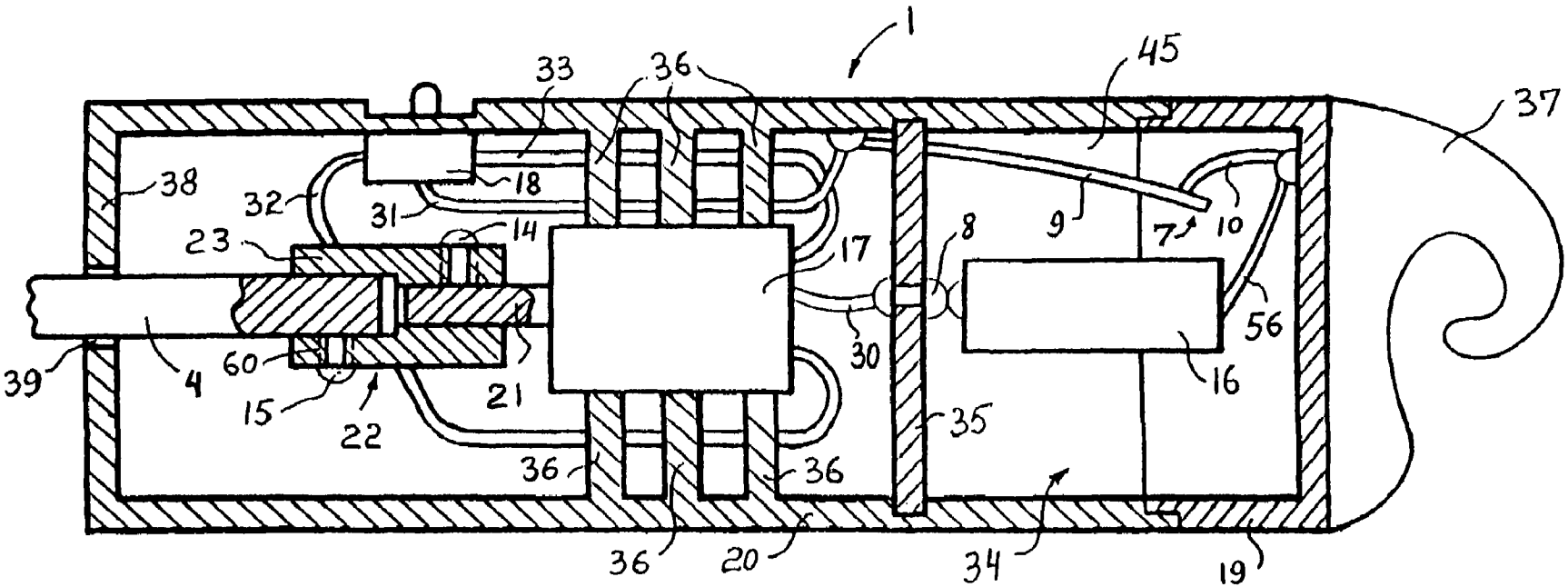
FIG. 7. is a simplified drawing of the handle portion with a handle lid.
Figure 8:
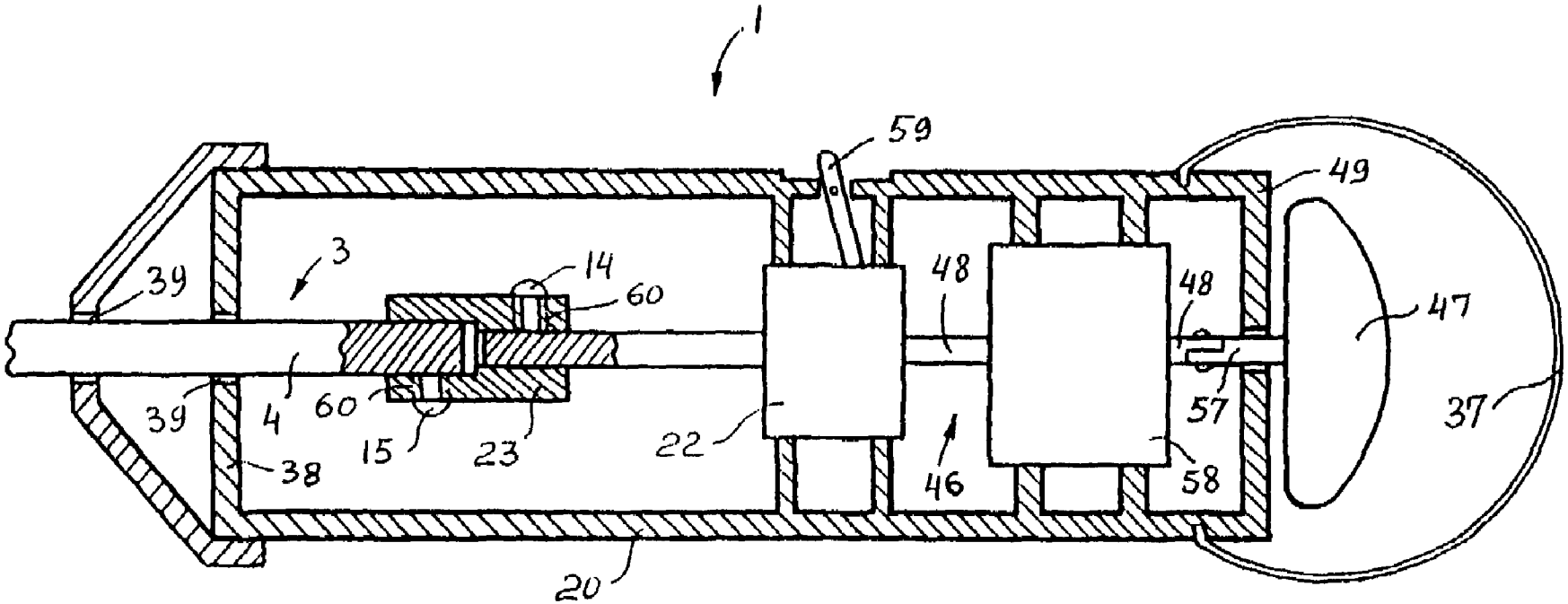
FIG. 8 is a simplified drawing of the mechanically power-driven portable cleaning device.

The handle means 20 also can comprise the handle lid (top) 19 intended for electrical power supply (battery and/or batteries) 16 replacement through the opening 45 in the handle means 20, as shown in FIG. 7.

The handle lid 19 of the handle portion 1 is coupled with the handle means 20 and is detachable.

If, the improved portable cleaning device is configured with the handle lid 19, as it is for example shown on FIG. 7, the electrical connection of the battery 16 into electrical circuitry is provided by the electrical contact 8, and by the power supply connecting means 7 ("PCM" in FIG. 4). The power supply connecting means 7 can be presented by a first spring electrical contact 10, and the second spring electrical contact 9. In this case, the electrical circuitry is configured as following. The electrical contact 8, installed on the power supply compartment wall 35 of the power supply compartment 34, connects one pole of the battery 16 (positive or negative depending on the type of motor 17) to the motor 17 via the first electrical wire 30. The first spring electrical contact 10, fixedly installed on the handle lid 19, connects the another pole of battery 16 (respectively negative or positive) via second spring contact 9, installed on the handle means 20, and via second electrical wire 31 to the switching means 18, which by third 32 and fourth 33 electrical wires is connected to the motor 17 ("EM"), as shown on FIG. 4. The electrical contact 8 can have the spring configuration (not shown).

Referring to FIGS. 2, 7 the power supply compartment wall 35 is conditionally shown, for example, as a solid wall of non-electrically conducted material, but the power supply compartment wall 35 can be of any material, form and/or configuration, or can be presented by the entire (solid) electrically conducted plate (entire electrical contact) operating as the compartment wall 35 and as the electrical contact 8 at the same time.

When the handle lid 19 is inserted in/on the handle means 20 of the handle portion 1, the second spring electrical contact 9 and the first spring electrical contact 10 are connected (see, for example, FIG. 7). The power supply connecting means 7 can be also presented by any kind of electrically contacting systems, means and elements, for example, by an electrical switch (not shown), e.g. such as a knob-switch (not shown), etc. The electrical knob-switch can be installed, for instance, on the inner surface of the handle means 20 or in the handle lid 19, and when the handle lid 19 is inserted in/on the handle means 20, the knob (not shown) of the knob-switch is depressed (pushed) providing the electrical connection of the circuitry instead of the spring electrical contacts 9 and 10. The electrical knob-switch can be electrically connected by wire (not shown) to the first electrical contact 56 and by wire 31 to the switching means 18.

Also, the entire power supply compartment 34 can be detachable (not shown) instead of the handle lid 19 in order to provide battery/batteries replacement. In this case, the power supply compartment 34 takes functions of the handle lid 19 (the power supply compartment 34 "plays role" of handle lid 19).

The electrical contacts disclosed in this invention are not limited by their present description and can be of any geometrical form/shape, configuration, size/dimensions, and conducting material/product.

Any type of the electrical motor 17 installation, mounting or housing into handle means 20, and/or connection to or coupling with the handle means 20 can be used. For example, the coupling of the motor 17 with the handle means 20 can be provided by holder(s) 36, bracket(s) (not shown), extended corbel(s) (not shown), etc. The means coupling the motor 17 and the handle means 20 are not limited by their present description and can be of any geometrical form/shape, configuration, size/dimensions, material, etc. Some possible types of the motor holder(s) 36 are shown in FIGS. 2, 7.

Also, the portable cleaning device can include a stand (not shown) instead of the hanging means 37 for holding and convenient storage of the portable cleaning device.

Depending on the type of the electrical motor 17, any type of switching means 18 and electrical wiring can be used and are not limited by their present description and can be of any geometrical form/shape, configuration, size/dimensions, material, etc.

The connection means 22 can be located outside of the handle portion 1 (not shown), and in this variant (not shown) the motor axle (main axle) 21 is extended (not shown) through the aperture 39 of front wall 38 from the handle means 20 (the motor 17 is located next to the front wall 38—not shown). Also, for example, the connecting element 23 of the connection means 22 can be located (not shown) into aperture 39, and connection of the first telescopic section 4 to the connecting element 23 is provided outside of the handle means 20.

The rotation of the brush portion 2 can be also provided by a power-driven mechanical means 46. The mechanical means 46 can be presented by a mechanism actuated by spring 58 for brush portion 2 rotation. In this case, the improved portable cleaning device comprises an outer actuating handle 47 mounted on the back wall 49 of the handle means 20 as shown in FIG. 8 and coupled with the spring 58 (any kind of spring can be used, for instance, a spiral spring, torsional spring/both not shown/, etc.) comprising a shaft 48, the one side of which is coupled with the first telescopic section 4 of the telescopic portion 3 via connection means 22. The connection means 22 can be presented, for example, by any kind of mechanical connecting means, elements and systems, including any mechanical transmitting systems and means, for example, such as friction transmitting system (not shown) or gear transmitting system (not shown), etc. The another side of the shaft 48 is coupled (for example, by a connecting element 23) with the axle 57 of the handle 47. The gear transmitting system (not shown) can change direction of the rotation (clockwise/counterclockwise) by the mechanical switching means 59 located, for example, on the handle means 20.

The hanging means 37 in this variant can be mounted in any convenient place on the handle means 20, for example, on the cylindrical surface of the handle means 20, as it is conditionally shown on FIG. 8.

CONCLUSION, RAMIFICATION AND SCOPE

Accordingly the reader will see that, according to the invention, I have provided a convenient portable cleaning device. There has thus been outlined, rather broadly, the more important features of the invention. In this respect, it is understood that the invention is not limited in its application to the details of construction and to the arrangements of the components set forth in the description and/or drawings. The invention is capable of other embodiments and of being practiced and carried out in various ways. Also, it is to be understood that the phraseology and terminology employed herein are for the purpose of description and should not be regarded as limiting.

While the above description contains many specificities, these should not construed as limitations on the scope of the invention, but as exemplification of the presently-preferred embodiments thereof. Many other ramifications are possible within the teaching to the invention. For example, an improved portable cleaning device can be successfully used by elderly people, having general physical limitations, and the users who are incapable manually rotate brush (e.g. the users with polyarthritis disease, fingers/wrist/hand coordination malfunction, etc.).

As such, those skilled in the art will appreciate that the conception, upon which this disclosure is based, may readily be utilized as a basis for the designing of other structures, for carrying out the several purpose of the present invention. It is important, therefore, that the claims be regarded as including such equivalent constructions insofar as they do not depart from the spirit and scope of the present invention.

THE DRAWING REFERENCE NUMERALS

1.—a handle portion;
2.—a brush portion;
3.—a telescopic portion;
4.—a first telescopic section;
5.—a second telescopic section;
6.—a third telescopic section;
7.—a power supply connecting means;
8.—a second electrical contact;
9.—a second spring electrical contact;
10.—a first spring electrical contact;
11.—a switching means position "OFF";
12.—a switching means position "RIGHT";
13.—a switching means position "LEFT";
14, 15—a screw,
16.—an electrical power supply;
17.—a reversible electrical motor;
18.—a switching means;
19.—a handle lid;
20.—a handle means;
21.—a motor axle;
22.—a connection means;
23.—a connecting element;
24.—a gear transmitting means;
25.—a threaded portion of the third telescopic section 6;
26.—a brush axle;
27.—cleaning brush;
28.—a threaded opening of the brush axle 26;
29.—a fixing means;
30.—a first electrical wire;
31.—a second electrical wire;
32.—a third electrical wire;
33.—a fourth electrical wire;
34.—an electrical power supply compartment;
35.—a power supply compartment wall;
36.—a holder;
37.—a hanging means;
38.—a front wall of the handle means 20;
39.—an aperture,
40.—a first conic gear;
41.—a second conic gear;
42.—a third conic gear;
43.—a fourth conic gear;
44.—a free end of the brush axle 26;
45.—an opening of the handle means 20;
46.—a mechanical power supply;
47.—a handle;
48.—a shaft of the spring 58;
49.—a back wall of the handle means 20;
50.—an axle of the first conic gear 40;

51.—an axle of the second conic gear 41;
52.—an axle of the third conic gear 42;
53.—an axle of the fourth conic gear 43;
54.—a first gear;
55.—a second gear;
56.—a first electrical contact;
57.—an axle of the handle 47;
58.—a spring;
59.—a mechanical switching means;
60.—a threaded aperture;
61-61 and 62-62 are the cross-sectional views of the telescopic portion 3.

What is claimed is:

1. A portable cleaning device, comprising:

a brush portion including a telescopic portion comprising at least two of a plurality of telescopic sections;

a cleaning brush comprising a brush axle which is coupled with an appropriate retractable telescopic section of said plurality of telescopic sections of said telescopic portion of said portable cleaning device;

a fixing means coupling said brush axle with said appropriate retractable telescopic section of said plurality of telescopic sections of said telescopic portion;

a handle portion comprising a mechanical power supply located in said handle portion of said portable cleaning device, and wherein said power supply includes a main axle coupled with a non-retractable telescopic section of said plurality of telescopic sections of said telescopic portion of said portable cleaning device, and wherein said power supply provides a rotation of said main axle;

a mechanical means including an actuating handle comprising an actuating handle axle rigidly connected by one end with said actuating handle, and wherein said actuating handle is mounted on a back wall of said handle means of said handle portion of said portable cleaning device;

a spring located in said handle means and mechanically coupled with a spring shaft which is coupled with said actuating handle axle of said mechanical means of said mechanical power supply of said portable cleaning device;

a handle means including at least one front wall which comprises an aperture, and a power supply compartment which includes at least one of a plurality of holders preventing a displacement of said mechanical power supply inside said handle means of said handle portion of said portable cleaning device;

a mechanical switching means mechanically coupled with said main axle, wherein said mechanical switching means provides a control of said mechanical power supply of said portable cleaning device, and wherein said mechanical switching means comprises three positions, wherein a first position of said three positions provides a turning-off said mechanical power supply, a second position of said three positions provides a clockwise rotation of said main axle, and a third position of said three positions provides a counterclockwise rotation of said main axle, and wherein a switching from said second position to said third position or said switching from said third position to said second position is provided through said first position of said mechanical switching means, and wherein the coupling of said spring shaft with said main axle is provided through said mechanical switching means;

a hanging means which is coupled with said handle means or extended from said handle means.

2. The device of claim 1, wherein said main axle of said mechanical power supply is further coupled with said non-retractable telescopic section of said plurality of telescopic sections of said telescopic portion of said portable cleaning device through a connection means, and wherein said aperture in each or in said at least one front wall is intended to provide an unobstructed passage of said non-retractable telescopic section of said telescopic portion or said unobstructed passage of a connecting element, or said unobstructed passage of said main axle of said mechanical power supply.

* * * * *